United States Patent [19]

Manders

[11] 4,404,996

[45] Sep. 20, 1983

[54] METHOD FOR INSERTING AND STRETCHING A MEASURED WEFT YARN LENGTH INTO THE WEAVING SHED OF A SHUTTLELESS WEAVING MACHINE

[75] Inventor: Petrus G. J. Manders, Eindhoven, Netherlands

[73] Assignee: Ruti-Te Strake B.V., Netherlands

[21] Appl. No.: 287,155

[22] Filed: Jul. 27, 1981

[30] Foreign Application Priority Data

Aug. 11, 1980 [NL] Netherlands ..... 8004551

[51] Int. Cl.[3] ..... D03D 47/34; D03D 47/28

[52] U.S. Cl. ..... 139/194; 139/435

[58] Field of Search ..... 139/194, 435, 450–452

[56] References Cited

U.S. PATENT DOCUMENTS 3,744,533 7/1973 Yano et al. ..... 139/194
3,880,198 4/1975 Vermeulen ..... 139/435
3,901,286 8/1975 Vermeulen et al. ..... 139/194 X
4,096,889 6/1978 Larmit ..... 139/194 X

FOREIGN PATENT DOCUMENTS 47-42075 10/1972 Japan ..... 139/435
189478 5/1964 Sweden ..... 139/435

*Primary Examiner*—James Kee Chi
*Attorney, Agent, or Firm*—C. O. Marshall, Jr.

[57] ABSTRACT

A method for inserting a measured weft thread length by means of a blowing nozzle, in which the transport air jet at the end of the weaving shed remote from said nozzle is deviated together with the thread length end through an angle relative to the insert direction and is entered into a mixing tube by means of an auxiliary air jet. The invention aims at having the auxiliary air jet acting substantially only for stretching the thread directly beside the cloth edge. This is achieved in that the auxiliary air jet is supplied as a concentrated jet centrally into the deviating transport air jet.

2 Claims, 2 Drawing Figures

Figure 1:
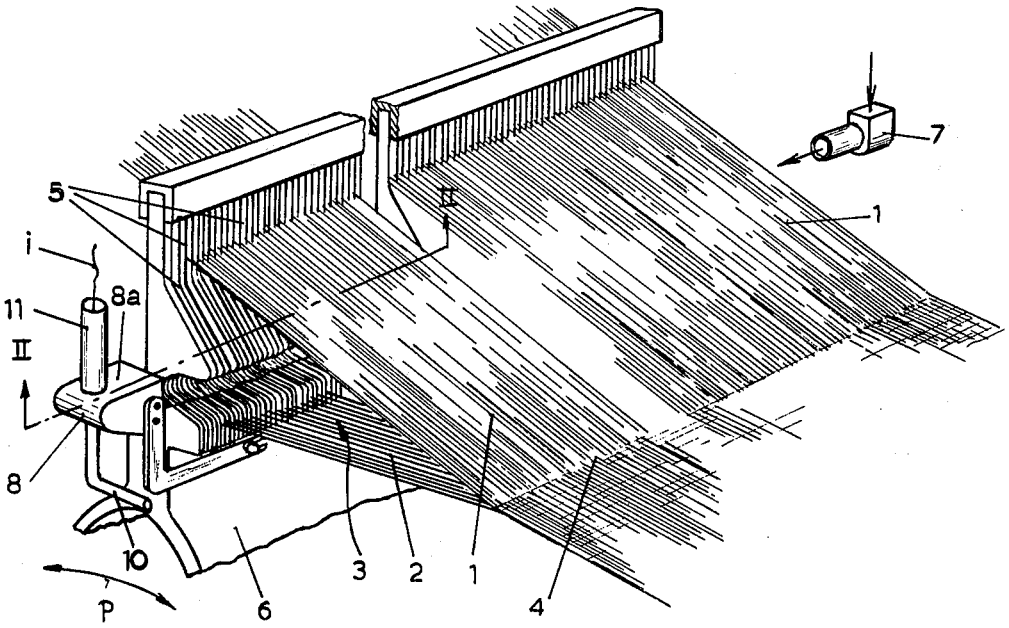

METHOD FOR INSERTING AND STRETCHING A MEASURED WEFT YARN LENGTH INTO THE WEAVING SHED OF A SHUTTLELESS WEAVING MACHINE

The invention relates to a method for inserting and stretching a measured weft yarn length into the weaving shed of a shuttleless weaving machine whereby the yarn length is transported through the weaving shed through the intermediary of a transport air jet issued by a blowing nozzle mounted at one end of the weaving shed and whereby the transport air jet is deviated at the other end of the weaving shed, together with the end of the inserted yarn length projecting beyond the weaving shed, through an angle relative to the weft direction and is guided into a mixing tube by means of an auxiliary air jet supplied in the direction of the deviation.

A similar method is known from the Dutch patent application 7211208 (=DE 2.341.234; GB 38747/73; CH 563479; U.S. Pat. No. 3,901,286). In this method the auxiliary air jet is supplied annularly around the deviated transport air jet. The disadvantage of this method is that the energy of the auxiliary air jet is not mainly used for stretching the weft thread but thereby in the first place the total quantity of transport air must be sucked in and must be accelerated. Additionally the auxiliary air jet is in this manner supplied relatively far downstream of the relative cloth edge so that the weft thread ends projecting beyond said cloth edge have to be kept relatively long so that the weft yarn waste is relatively large.

Proposals have already been made to eliminate this disadvantage. Methods are known from the British Pat. No. 1,365,903 and from the Dutch patent application 7605882 (=DE 2.700.119; GB 208/77; CH 17/77) for inserting and stretching a measured weft yarn length into the weaving shed of a shuttleless weaving machine, whereby the transport air jet is not deviated at the other end of the weaving shed so that it is permitted to flow out for the greater part along the entrance of the mixing tube which is mounted under an angle (that is substantially perpendicular to the weft direction). The auxiliary air jet thereby is guided in the shape of a concentrated jet transversally through the substantially linearly continuing transport air jet into the mixing tube and thereby sucks along only part of the transport air jet. The purpose thereof is to have taken along the projecting end of the inserted weft yarn length by the auxiliary air jet so that the weft length is stretched taut. Generally this stretching method operates satisfyingly, particularly when the transport air jet and therefore the weft thread piece to be inserted through the weaving shed are guided along a channel having small cross-sectional dimensions. Nevertheless it happens, particularly with heavier yarn types, that the head end of the inserted weft thread length at first passes the auxiliary air jet and is sucked into the mixing tube only at a later moment. In that moment the change of weaving shed and thereby the binding of the inserted weft thread may already have progressed so far that the relative weft thread length is not fully stretched.

The invention aims at providing a method whereby both types of disadvantages as indicated above are eliminated.

According to the invention a return is made to a method of the type as described at the start of this specification whereby the transport air jet at the other end of the weaving shed is deviated into the direction of the mixing tube.

The purpose aimed at by the invention is thereby achieved in that the auxiliary air jet is supplied as a concentrated jet centrally into the deviating transport air jet.

In this manner it is no longer possible that the head end of an inserted weft thread length initially passes the entrance to the mixing tube since said head end is simply urged towards the mixing tube together with the deviating transport air jet. Contrary to the method from which the invention starts the deviating head end of the inserted weft thread length thereby enters directly into the influence of the very high air velocity which is obtained by the concentrated auxiliary air jet. Thereby a quick force transmission takes place from the auxiliary air jet to the thread to be stretched, which guarantees a quick and efficient stretching process.

The invention likewise relates to a shuttleless weaving machine of the type in which a transport tunnel has been formed on the reed for the measured insert thread length and in which a blowing nozzle is mounted at one side of the weaving shed for supplying a transport air jet whereby each time a measured weft thread length may be inserted from one side to the other side of the weaving shed through the transport tunnel, while at the other side of the weaving shed a device is provided, operating through an auxiliary air jet, for stretching and keeping taut during the beating up movement of the reed an inserted weft thread length, said device comprising a guiding piece joined with the transport tunnel and guiding to a mixing tube extending under an angle relative to the axis of the transport tunnel and which is further provided with means for supplying the auxiliary air jet.

The weaving machine according to the invention differs from the known weaving machine of this type as described in the Dutch patent application 7211208 mentioned above in that the means for supplying the auxiliary air jet are arranged such that said air jet is entered downstream of the entrance of the mixing tube into the guiding piece as a concentrated air jet directed according to the axis of the mixing tube.

The invention is hereunder further illustrated with reference to the drawing of an embodiment.

Figure 2:
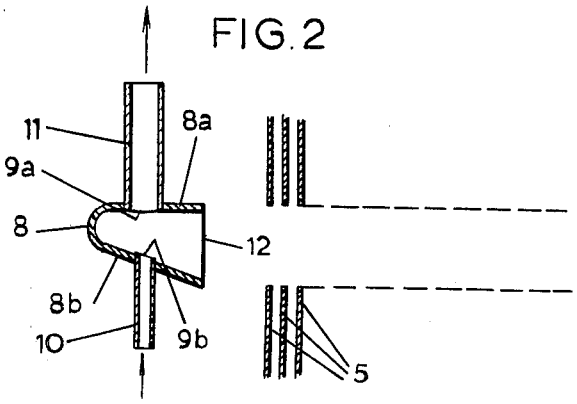

FIG. 1 is a perspective view of a part of the reed of a pneumatic weaving machine provided with a stretching device according to the invention and FIG. 2 is a cross-section according to the line II—II in FIG. 1.

Although up til now and also in the following description the terms air jet or air flow are used it will be clear that instead of air also another suitable flowing fluid for the transport and the stretching of the weft yarn may be used. Therefore the term air must be considered as a broad expression.

According to the drawing a tunnel shaped transport channel is formed in the weaving shed 3 constituted by the upper and the lower warp threads 1 and 2, namely by the substantially U-shaped reed lamellae 5 facing with their openings the beating up line 4, said lamellae being contained in the reed beam 6 movable reciprocatingly according to the arrow P.

At one side of the machine a blowing nozzle 7 is provided which may be fixedly mounted to the reed beam 6 in a known manner not further shown in the drawing and is adapted to launch a measured weft thread length by means of an air jet through the reed tunnel channel. At the side of the weaving machine remote from the blowing nozzle 7 the stretching device according to the invention is provided. Said device comprises a guiding piece 8 arranged in the projection of the transport tunnel and secured to the reed beam 6, which is adapted to receive the transport air jet leaving the transport tunnel at the relative side as well as to receive and further guide the weft thread length carried along with that jet. The guiding piece therefore has a receiving aperture 12 facing the relative tunnel end and is further circumferentially closed, as well as at the end remote from the transport tunnel. In each of both opposite side walls of the guiding piece 8, indicated 8*a* and 8*b* respectively, there is provided an air passage aperture 9*a* and 9b respectively. Said apertures 9*a* and 9*b* are directly one above the other, i.e. such that the common axis thereof intersects the extension of the transport tunnel axis substantially perpendicularly or crosses this extension at short distance. The lower aperture 9*b* is connected to a supply conduit 10 for pressurized air, whereas the aperture 9*a* in the upper wall 8*a* constitutes the entrance to a mixing tube 11.

When a measured weft thread length is entered into the weaving shed by means of the blowing nozzle 7, the transport air jet leaving the transport tunnel is received by the guiding piece 8 and deviated towards the mixing tube 11 which is directed upwardly in the embodiment of the drawing. This deviation is furthered in that the bottom wall 8*b* of the guiding piece rises obliquely as seen in the main transport direction. The head of the weft thread length thereby enters the direct influence of the concentrated air jet leaving the aperture 9*b*, which takes along the head of the thread length towards the mixing tube 11 in which said air jet mixes with the deviated transport air jet. The end portion of the inserted weft thread projecting beyond the relative cloth edge then frictionally engages the edge of the mouth of the mixing tube 11. It appeared that said frictional contact is of paramount importance to keep the inserted weft thread stretched or taut during the beating up and binding into the cloth.

FIG. 1 shows the machine in a position in which the stretching device is operative for stretching a weft thread length i which has been inserted, while the reed 5, 6 is operative in moving from its retracted position towards the beating up line 4.

It will be clear that when the reed 5, 6 has carried out its beating up movement and thereafter returns to its retracted position the insert thread remains in its position in which it has been beaten up into the cloth and has in the meantime been bound into the cloth and that the portion of the weft thread projecting beyond the cloth edge is then retracted from the mixing tube 11. This insert thread end projecting beyond the cloth edge is thereafter cut in a manner known per se and is removed by a suction nozzle not further shown in the drawing.

I claim:

1. A method of inserting and stretching a measured weft thread length in the weaving shed of a shuttleless weaving machine, comprising the step of transporting the thread length through the shed by means of a transport air jet injected into one end of the shed, wherein the improvement comprises the steps of passing the transport air jet, at the other end of the shed, into an inlet formed in a receptacle which has an outlet in the form of a mixing tube extending at an angle to the axis of the transport air jet, the end of the receptacle opposite to said inlet being closed and the wall of the receptacle opposite to said outlet being inclined to the axis of the transport air jet at such an angle as to deflect said transport air jet into said outlet, and injecting a concentrated auxiliary air jet into said outlet along the axis of said mixing tube.

2. A shuttleless weaving machine comprising two sheets of warp threads which are momentarily held in diverging planes to form a weaving shed, and a blowing nozzle arranged at one end of the shed for injecting a transport air jet to transport a measured weft thread length through the shed, wherein the improvement comprises a receptacle at the other end of the shed, having an inlet aligned with the transport air jet to receive said jet, and having an outlet in the form of a mixing tube extending at an angle to the axis of the transport air jet, the end of the receptacle opposite to said inlet being closed and the wall of the receptacle opposite to said outlet being inclined to the axis of the transport air jet at such an angle as to deflect said transport air jet into said outlet, and an auxiliary blowing nozzle arranged to inject an air jet into said outlet along the axis of said mixing tube to stretch the thread length in the shed.

* * * * *